US006342032B1

(12) United States Patent
Affield

(10) Patent No.: US 6,342,032 B1
(45) Date of Patent: Jan. 29, 2002

(54) EXERCISE DEVICE

(76) Inventor: Timothy B. Affield, 19404 River Rd., Marengo, IL (US) 60152

( * ) Notice: Subject to any disclaimer, the term of this patent is extended or adjusted under 35 U.S.C. 154(b) by 0 days.

(21) Appl. No.: 09/733,283

(22) Filed: Dec. 8, 2000

(51) Int. Cl.[7] ..... A63C 17/28; A63B 22/02

(52) U.S. Cl. ..... 482/74; 280/826; 280/11.2; 135/85

(58) Field of Search ..... 280/836; 135/56, 135/85, 66, 69, 71, 74

(56) References Cited

U.S. PATENT DOCUMENTS

| | | | | |
|---|---|---|---|---|
| 1,527,239 A | * | 2/1925 | Vaughan et al. | 280/836 |
| 1,541,763 A | * | 6/1925 | Dunberg | 280/836 |
| 1,608,238 A | * | 11/1926 | Riefschnider | 280/836 |
| 3,831,942 A | | 8/1974 | DelMar | |
| 3,860,235 A | | 1/1975 | Del Mar | |
| 4,029,311 A | | 6/1977 | Chanslor et al. | |
| 4,194,751 A | | 3/1980 | Shinmura | |
| 4,962,781 A | | 10/1990 | Kanbar | |
| 4,986,261 A | | 1/1991 | Iams et al. | |
| 5,188,138 A | | 2/1993 | Yamasaki et al. | |
| 5,312,120 A | | 5/1994 | Wiegner | |
| 5,456,655 A | | 10/1995 | Morris | |
| 5,460,586 A | | 10/1995 | Wilkinson et al. | |
| 5,653,468 A | | 8/1997 | Ostapyk | |
| 5,687,991 A | | 11/1997 | Gairdner | |
| 5,803,874 A | | 9/1998 | Wilkinson | |
| 5,871,421 A | | 2/1999 | Trulaske et al. | |
| D411,474 S | | 6/1999 | Gairdner | |
| 5,913,373 A | | 6/1999 | Forrest | |
| 5,938,240 A | | 8/1999 | Gairdner | |
| 6,082,768 A | | 7/2000 | Johnson | |
| 6,090,015 A | | 7/2000 | Meyers | |

* cited by examiner

*Primary Examiner*—Jerome W. Donnelly
(74) *Attorney, Agent, or Firm*—Mathew R. P. Perrone, Jr.

(57) ABSTRACT

A wheel-mounted exercise device, has a brake cooperating with the wheel at one end of a tube, and a hand grip at the other of the tube, adapted to provide a hand position for proper exercise.

8 Claims, 3 Drawing Sheets

EXERCISE DEVICE

EXERCISE DEVICE

This invention relates to an exercise device, and more particularly to a wheel mounted exercise device providing for proper use of the arms during a walking exercise.

BACKGROUND OF THE INVENTION

Physical fitness has great importance for the human race, whether for a caveman, as a matter of life and death; and for today, as a contribution to the basic well-being of a person. The physically fit person can endure stress more efficiently and feel better while so doing. Physical fitness is also related to mental conditioning. For example, a chess player strives to be in good physical condition, as a necessity before. engaging in serious competition.

Walking is an outstanding exercise. If proper use of the arms can be provided during the course of walking greater advantages can be obtained with the period of walking. However, the stroke or swinging of the arms, during the walking, sometimes is not used to the greatest advantage in providing the most effective exercise. Furthermore, the stroking of the arms in a proper fashion may interfere with the rehabilitative nature of walking in the event of recovery from an injury or other appropriate action.

It is well known to use a stick or cane to aid walking. The conventional walking stick has a handle grip for the user to grip. By holding on to the handle, the user may lift the walking stick body and move it forward. As the stick rests on the ground, the walker may move the feet to the appropriate point. Thus, a person uses the stick to walk as a supporting tool for walking by repeatedly lifting and putting the stick down. Such lifting and putting the stick down can be strenuous.

What is needed is a wheeled walking support stick that permits the arm movement of the user to provide the proper motion and achieve the desired results, including, but not limited to, promoting a proper walking with a proper arm swing. Accordingly, it is desired to modify the wheeled walking to achieve these goals.

There are also more standard reasons to be in good physical condition. A person in good physical condition feels better and looks better than a person who is not in good condition.

Now there are studies which have determined that certain groups of muscles will develop in certain ways. With such interest in physical fitness is a corresponding interest in developing devices to assist in attaining the appropriate degree of physical fitness. These devices have an application in the science of kinesiology.

From the studies in kinesiology, it is known that to best train, tone or otherwise improve a group of muscles, a variable resistance is best applied over the full range of muscle function. This variable resistance is applied so that the most resistance is achieved at the high leverage points of the muscle. Such a variable resistance is clearly an especially critical training improvement for professional athletes and others who depend on physical skill for their livelihood. Also, such action is extremely useful for anyone undergoing physical therapy or related treatments.

The only accurate way to overcome the problems with regard to measurement at this time is to have a plurality of devices and a complicated connection mechanism to get to the desired readouts. Such complications add to price and detract from the capability of the device being readily accessible for exercise. Also, as the complexity of the device increase, the cost increases and the manufacturing skill required increases.

Also, critical is the hand position on the device. If the hand position is proper, the stroking of the arm is more likely to remain in a proper position. Without a proper hand position, it is quite possible to deviate from the required positioning in order to achieve the proper exercise. With one walking device for each hand, greater advantages of exercise are obtained.

SUMMARY OF THE INVENTION

Among the many objectives of this invention is the provision of a wheel mounted exercise device with a braking mechanism to insure proper arm motion during walking.

A further objective of this invention is the provision of a wheel mounted exercise device to assist with physical therapy.

Yet a further objective of this invention is the provision of a wheel mounted exercise device to assist with muscle development.

A still further objective of this invention is the provision of a wheel mounted exercise device to cooperate with principles of kinesiology.

Another objective of this invention is the provision of a wheel mounted exercise device as a walking device.

Yet another objective of this invention is the provision of a wheel mounted exercise device to avoid lifting of the device.

Still, another objective of this invention is the provision of a wheel mounted exercise device promoting proper arm motion.

Also, an objective of this invention is the provision of a wheel mounted exercise device for use by a professional athlete.

A further objective of this invention is the provision of a wheel mounted exercise device as a walking support.

A still further objective of this invention is the provision of a wheel mounted exercise device with a handle requiring a proper hand position.

These and other objectives of the invention (which other objectives become clear by consideration of the specification, claims and drawings as a whole) are met by providing a wheel mounted exercise device, with a brake cooperating with the wheel at one end of a tube, and a hand grip at the other of the tube providing a hand position for proper exercise.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
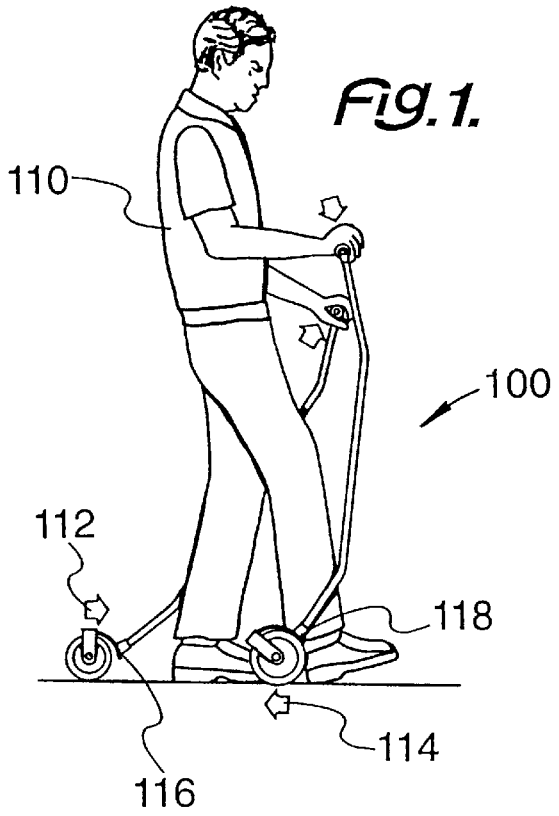
FIG. 1 depicts a perspective view of the wheel mounted exercise device 100 of this invention in use in pairs.

A walking device has a wheel and a brake assembly for the wheel mounted at one end of a rod or tube; and a hand grip mounted at the other end of the rod or tube. The wheel and brake assembly both cooperate with the handle.

The handle positions the hand properly on the handgrip, and the brake and wheel assemblies provide the proper arm motion. This combination provides a very effective walking exercise. Most preferably, each arm is oriented 180 degrees relative to shoulder, chest and hip alignment. This structure requires the hand and forearm to be in the position that they would be in if they were called upon for walking.

Preferably, these walking devices are used in pairs and intended to harness arm swing reflexes, naturally and effectively. In this manner, the arms are engaged in normal walking activity, while increasing the efficiency of the exercise.

The rod or tube may have any suitable cross-section. Circular is the preferred cross-section. By the same token, whether the elongated connecting device for the handle and the wheel assembly is a solid rod or a hollow tube, the exercise device may be formed. Furthermore, the elongated connecting device may include an adjusting mechanism to adjust the length thereof and permit people of different heights to use the same device.

This walking devices offer a low impact aerobic exercise routine, while having all of the major muscle groups of the body fully participating in a natural balanced rhythm, with normal walking activity. Most preferably, these walking devices are used both as a pair and in an out-of-door environment.

Each walking device has several unique features. Firstly, the walking device provides a structure with simplicity. Only three moving parts are present. Also, the overall design is attractive, useful and effective.

Furthermore, this walking device is the only arm operated walking device, which both enhance walking as an exercise and is carried or otherwise positioned behind the user during use. In this manner, the walking device stays out of harm's way. In fact, with properly applied technique, the walking devices are substantially invisible to or unseen by the user, or at least out of the line of sight of a user. While it is not desired to be bound by any particular theory, it is believed that the handle and brake structure permit this usage.

With the handle design, preferably oriented 180 degrees relative to a proper shoulder, chest and hip alignment, the hand and forearm are allowed to be in the position that they, most preferably, must be in if they are called upon for walking. Additionally, the wrist structure fully participates in movement with the arm swing. This result is completely different from rapid walking sticks. A further advantage results, because no friction is experienced by the palms of the user.

To eliminate palm friction, the handle is rollered on its axis and shaped as a wide cam, with a purposefully designed twist to form with the contour of the palm. The fingers lay across the fat surface of the cam while in use and are encouraged to stay open, thus giving fullest centrifugal effect to blood circulation during the arm swing.

This handle design accommodates a varying range of effort combinations of wrist, forearm and upper arms and shoulders. Specially, for example by rolling the fingers forward, the overall device becomes longer and more pumping or weight relief effort is called upon for the ulna side of the wrist structure.

With the ground wheel structure, no additional weight is experienced by the user. During operation, forward momentum actually gives the user a slight lift. Downward pressure of the arms actually gives the trunk structure a feeling of elongation, thereby most effectively toning the trapezium, deltoid and pectoral muscle groups. The brake feature of this, unlike other devices, is used to push off or start rather than to stop the exercise device.

A ratchet mechanism can also be used to limit the rotation of the wheel to one direction. This structure may eliminate or reduce the need for a braking mechanism.

In a preferred manner, an arcuate member connected to the wheel frame by a hinge can be used instead of the spring brake. There are less stress and more efficient use of materials. Also, the handle is more efficiently connected to the wheel. With the hinge designed to rotate slightly and provide contact and braking on the wheel, the problem with the repeated flexing of the leaf spring is avoided.

Also, with an adjusting member on the arcuate member, the effectiveness of the brake can be determined. The hinge can be positioned and the position of the arcuate member with the arm can be positioned relative to the wheel in order to achieve the desired efficiency of the arm swing back and forth. In this fashion, the walking device becomes more efficient.

Referring now to FIG. 1, wheel mounted exercise device 100 is used in pairs by a person 110. The wheel mounted, exercise device 100 includes, for the sake of discussion of the pair, a forward wheel device 112 and a rear wheel device 114. As the forward wheel device 112 shows brake off position 116 while the rear wheel device 114 shows the brake on position 118.

Figure 3:
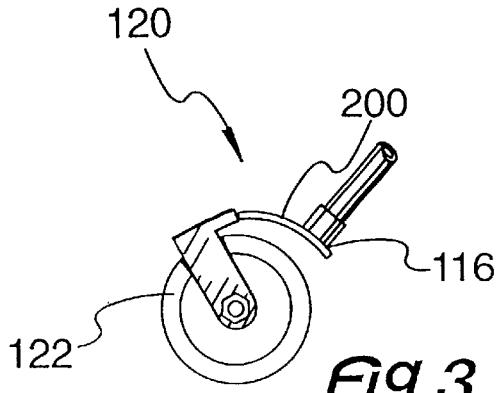
FIG. 3 depicts a side, assembled view of the wheel mounting assembly 120 for the wheel mounted exercise device 100 of this invention in brake off position 116.
Figure 2:
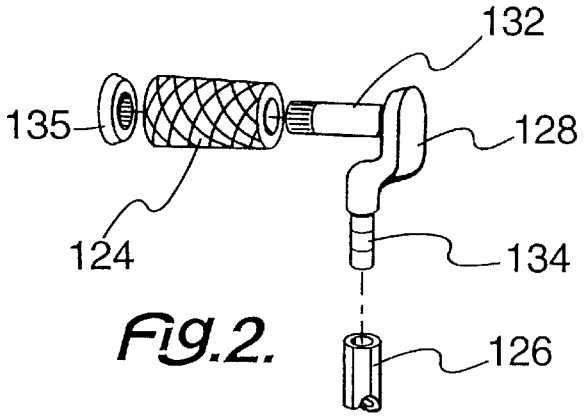
FIG. 2 depicts an exploded, perspective view of the wheel mounting assembly 120 for the wheel mounted exercise device 100 of this invention.

Adding FIG. 2 to the discussion, wheel bushing assembly 120 shows that the wheel 122, shown in FIG. 3, is mounted on a free turning bushing grip 124 and secured to elongated connecting device or tube 126 by plastic fitting 128. Plastic fitting 128 receives elongated connecting device or tube 126 at plug coupling 134. The journal 132 receives bushing grip 124 and is oppositely disposed from plug coupling 134 and at a right angle thereto. As wheel 122 slides over bushing grip 124, both are held on journal 132 with female cap 135.

Figure 4:
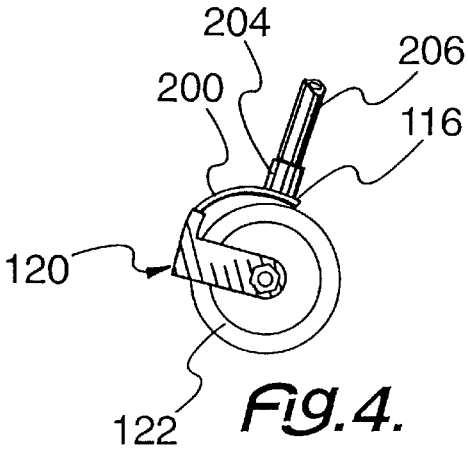
FIG. 4 depicts a side, assembled view of the wheel mounting assembly 120 for the wheel mounted exercise device 100 of this invention in brake on position 118.

With FIG. 3 and FIG. 4, the wheel mounting assembly 120 for the wheel mounted exercise device 100 is clarified. The plastic fitting 128 includes a journal 130 to receive the bushing grip 132 and a plug coupling 134 for fitting in the elongated connecting device 126. In this fashion, the wheel 122 can be mounted on the exercise device 100.

Figure 5:
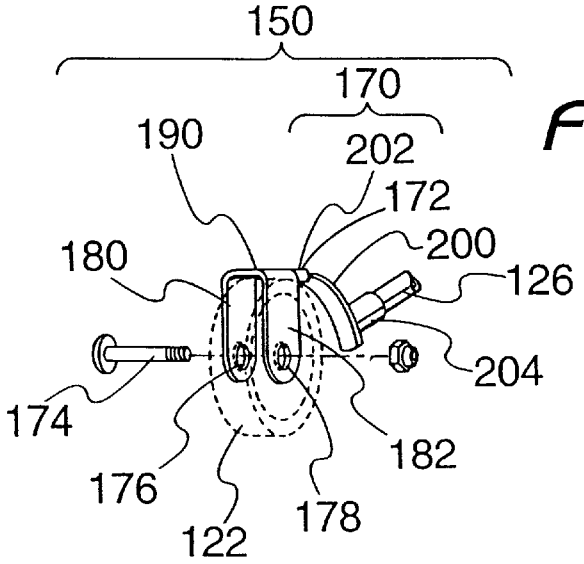
FIG. 5 depicts an exploded, perspective view of the wheel frame assembly 150 for the wheel mounted exercise device 100 of this invention.

In FIG. 5, the brake assembly 170 is spring mounted to the wheel frame 172 of wheel frame assembly 150. Wheel frame 172 provides an alternate mounting for wheel 122. The wheel frame 172 of course receives the wheel nut and bolt assembly 174 through first frame aperture 176 and second frame aperture 178, with wheel 122 mounted therebetween. The wheel frame 172, of course, is a U-shaped member having a first arm 180 with first aperture 176 therein and a second arm 182 with second aperture 178 to receive wheel nut and bolt assembly 174.

The brake assembly 170 cooperates with wheel frame 172. Mounted on the wheel frame base 190 of the wheel frame 172 is the spring steel brake 200. Preferably wheel frame base 190 is substantially flat, although other shapes are feasible. The spring steel brake 200 brake assembly 170 is secured at one end to the U-shaped member wheel frame 172. More particularly, spring steel brake 200 has a frame end 202 welded or otherwise secured to frame base 190.

Spring steel brake 200 is secured at tube end 204 to the tube 126 of wheel mounted exercise device 100. With the flexibility of the-steel brake 200, downward pressure on the tube 126 can cause the tube end 204 of brake 200 to be pressed against the wheel 122 and cause a braking action on the wheel 122, thereby permitting the arm stroke to remain proper, in order to provide proper exercise. Spring 200 is crimped or otherwise secured to frame base 190.

Figure 7:
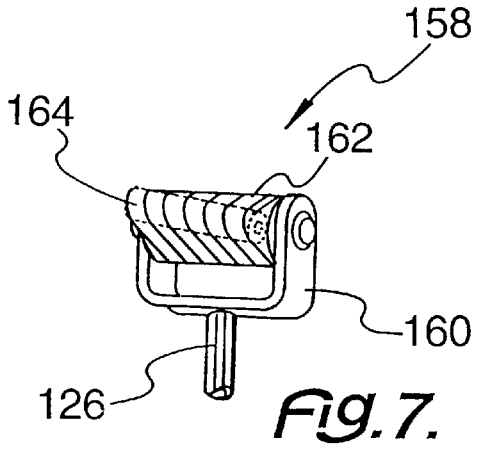
FIG. 7 depicts an assembled, perspective view of the handle assembly 158 for the wheel mounted exercise device 100 of this invention.
Figure 6:
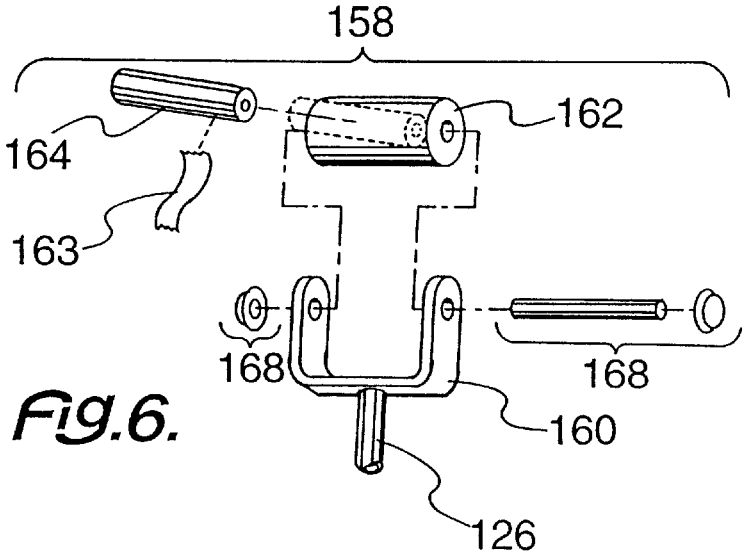
FIG. 6 depicts an exploded, perspective view of the handle assembly 158 for the wheel mounted exercise device 100 of this invention.

Adding FIG. 6 and FIG. 7 to the consideration, handle assembly 158 includes a preferably rounded or arcuate U-shaped handle frame 160 mounted on the walking elongated connecting device or tube 126. Handle assembly 158 is oppositely disposed from the brake assembly 170. Within handle frame 160 is mounted a main rotatable member 162. Secured to the main rotatable member 162 is a secondary rotatable member 164 having a smaller cylindrical diameter than the main rotatable member 162 mounted at a slight angle thereto. Main rotatable member 162 is secured to secondary rotatable member 164 with tape 163, or in another suitable fashion The main rotatable member 162 is mounted in handle frame 160 and rotates on handle nut and bolt assembly 168. Handle nut and bolt assembly 168 fits in handle frame 160. Handle frame 160 is mounted on elongated connecting device 126 and oppositely disposed from brake assembly 170.

More specifically, secondary rotatable member 164 has its outer side touching the outer side the main rotatable member 162, with the axis of each not being parallel. With such a relationship therebetween, the desired position of the hands is achieved and some desired results of the exercise are obtained. In this fashion, the desired wheel and the hand position is achieved.

Figure 8:
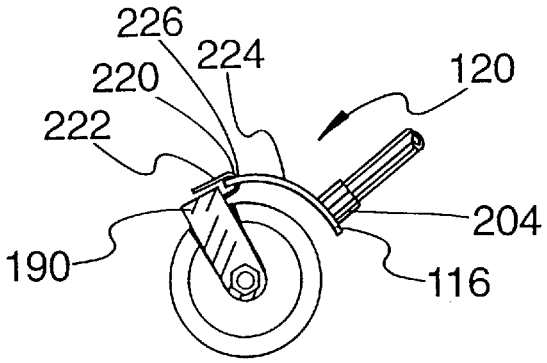
FIG. 8 depicts a side, assembled view of the wheel mounting assembly 120 for the wheel mounted exercise device lob of this invention in brake off position 116, using heel mount 220.

In FIG. 8, the wheel mounting assembly 120 for the wheel mounted exercise device 100 has a heel mount 220. Heel mount 220 includes a flat U-shaped member 222 secured at one end to frame base 190. Spring brake 200 of FIG. 5 is replaced by slotted arc member 224. Slotted arc member 224 has elongated slot 226 in one end thereof, whereby flat U-shaped member 222 may be received. Tube end 204 is secured to slotted arc member 224 in a standard fashion or in fashion similar to that shown in FIG. 3.

Figure 9:
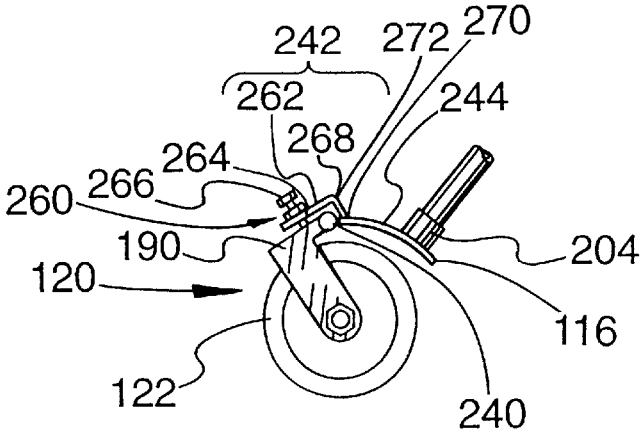
FIG. 9 depicts a side, assembled view of the wheel mounting assembly 120 for the wheel mounted exercise device 100 of this invention in brake off position 116, hinge heel mount 240.

With FIG. 9, the most preferred hinge mount 240 replaces heel mount 220 of FIG. 8. Hinge mount 240 has hinge assembly 242 at one end of hinged arc member 244. Hinged arc member 244 is movably secured to frame base 190 by hinge assembly 242 at one end thereof. Tube end 204 is secured to hinged arc member 244 in a standard fashion or in a fashion similar to that shown in FIG. 3.

Also FIG. 9, the optional hinge adjustment 260 is shown. Hinge adjustment assembly 260 includes angle spring adjusting arm 262 secured to frame base 190 at bolted end 264 by adjusting screw 266. Into bolted end 264 fits the adjusting screw 266 in threaded relation with the angle spring arm adjusting arm 262. Adjusting screw 266 is also secured spring adjustment arm 262 to frame base.190. Angled spring arm 262 is secured to frame base 190 at adjusting arm 268.

Adjusting arm 268 extends into spring tip 270 by means of spring angle 272. Due to spring angle 272, spring tip 272 may contact angle spring arm 262, and position the same relative to wheel 122, thereby adjusting device 100. Adjusting arm 268 may also be used with other assemblies to adjust wheel mounted exercise device 100.

Figure 10:
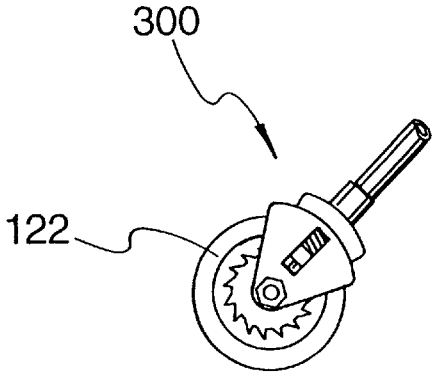
FIG. 10 depicts a perspective, exploded view of the wheel mounting assembly 120 for the wheel mounted exercise device 100 using pawl and ratchet assembly 300.

Referring now to FIG. 10, free turning plastic bushing grip 124 or wheel frame assembly 150 is replaced with pawl and ratchet assembly 300 cooperating with wheel 122. Such structure permits wheel 122 to turn in only one direction. The ratchet assembly 300 works well, but adds complications in manufacturing.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters of the United States is:

1. An exercise device comprising:

(a) an elongated connecting device supporting a wheel assembly at a first end thereof;

(b) the elongated connecting device supporting a handle assembly at a second end thereof;

(c) the first end being oppositely disposed from the second end thereof, (d) a brake assembly further including a leaf spring; the leaf spring connected to the base at a first spring end;

the leaf spring being connected to the base at a first spring end;

the leaf spring being connected to the elongated connecting device at a second spring end; and the first spring end being oppositely disposed from the second spring end;

the brake assembly cooperating with the wheel assembly to stop a wheel of the wheel assembly as desired and to release a wheel of the wheel assembly as desired; and (e) the handle assembly including a means to position a hand thereon in a desired position.

2. The exercise device of claim 1 further comprising:

(a) the wheel assembly including a fitting at one end of a journal;

(b) a plug being on the journal oppositely disposed from the fitting;

(c) the plug receiving the elongated connecting device; and (d) the fitting receiving the wheel.

3. The exercise device of claim 1 further comprising:

(a) the wheel assembly further including a U-shaped member;

(b) the-U-shaped member having a first arm and a second arm connected to a base;

(c) the wheel being received between the first arm and the second arm, and adjacent to the base;

(d) the wheel being rotatably mounted between the first arm and the second arm.

4. The exercise device of claim 3 further comprising:

(a) the handle including a handle frame with a gripping member mounted therein;

(b) the gripping member being rotatably mounted in the handle frame;

(c) the gripping member having a wide cam shape, in order to position a palm of a user.

5. The exercise device of claim 4 further comprising:

(a) the gripping member including a main rotatable member and a secondary rotatable member;

(b) the main rotatable member having a main axis of symmetry;

(c) the secondary rotatable member having a secondary axis of symmetry; and (d) the main axis of symmetry having a nonparallel relation to the secondary axis of symmetry.

6. An exercise device comprising:

(a) a connecting device supporting a wheel assembly at a first end thereof;

(b) the elongated connecting device supporting a handle assembly at a second end thereof;

(c) the first end being oppositely disposed from the second end thereof;

(d) brake assembly further including a leaf spring;

the leaf spring being connected to the base at a first spring end;

the leaf spring being connected to the elongated connecting device at a second spring end;

the first spring end being oppositely disposed from the second spring end;

the brake assembly cooperating with the wheel assembly to stop a wheel of the wheel assembly as desired and to release a wheel of the wheel assembly as desired;

(e) the handle assembly including a means to position a hand thereon in a desired position;

(f) the handle including a handle frame with a gripping member mounted therein;

(g) the gripping member being rotatably mounted in the handle frame;

(h) the gripping member having a wide cam shape, in order to position a palm of a user.

7. The exercise device of claim 6 further comprising:

(a) the gripping member including a main rotatable member and a secondary rotatable member;

(b) the main rotatable member having a main axis of symmetry;

(c) the secondary rotatable member having a secondary axis of symmetry; and (d) the main axis of symmetry having a nonparallel relation to the secondary axis of symmetry.

8. The exercise device of claim 7 further comprising:

(a) the wheel assembly including a fitting at one end of a journal;

(b) a plug being on the journal oppositely disposed from the fitting;

(c) the plug receiving the elongated connecting device;

(d) the fitting receiving the wheel;

(e) the wheel assembly further including a U-shaped member;

(f) the U-shaped member having a first arm and a second arm connected to a base;

(g) the wheel being received between the first arm and the second arm, and adjacent to the base;

(h) the wheel being rotatably mounted between the first arm and the second arm;

(i) the brake assembly being mounted between the base and the elongated connecting device; and (k) the brake assembly being adapted to contact the wheel.

* * * * *